US010530056B2

(12) United States Patent
Chen

(10) Patent No.: US 10,530,056 B2
(45) Date of Patent: Jan. 7, 2020

(54) ANTENNA STRUCTURE AND WIRELESS COMMUNICATION DEVICE USING SAME

(71) Applicant: Chiun Mai Communication Systems, Inc., New Taipei (TW)

(72) Inventor: Chang-Je Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/974,768

(22) Filed: May 9, 2018

(65) Prior Publication Data

US 2019/0214729 A1 Jul. 11, 2019

(30) Foreign Application Priority Data

Jan. 5, 2018 (CN) ..... 2018 1 0010809

(51) Int. Cl.

| | |
|---|---|
| ***H01Q 1/24*** | (2006.01) |
| ***H01Q 3/42*** | (2006.01) |
| ***H01Q 5/371*** | (2015.01) |
| ***H01Q 5/25*** | (2015.01) |
| ***H01Q 9/04*** | (2006.01) |

(52) U.S. Cl.

CPC ..... *H01Q 5/371* (2015.01); *H01Q 1/243* (2013.01); *H01Q 3/42* (2013.01); *H01Q 5/25* (2015.01); *H01Q 9/0464* (2013.01)

(58) Field of Classification Search

CPC ..... H01Q 1/243; H01Q 3/24; H01Q 3/42; H01Q 5/25; H01Q 5/371; H01Q 9/0464; H01Q 21/30

See application file for complete search history.

(56) References Cited

U.S. PATENT DOCUMENTS

| | | | | |
|---|---|---|---|---|
| 2015/0084817 | A1 | 3/2015 | Yong | |
| 2017/0040667 | A1* | 2/2017 | Lee | H01Q 1/243 |
| 2017/0117613 | A1* | 4/2017 | Wei | H01Q 21/30 |
| 2017/0365914 | A1* | 12/2017 | Hong | H01Q 3/24 |

FOREIGN PATENT DOCUMENTS

| | | |
|---|---|---|
| CN | 204303980 | 4/2015 |

* cited by examiner

*Primary Examiner* — Hoang V Nguyen
(74) *Attorney, Agent, or Firm* — ScienBiziP, P.C.

(57) ABSTRACT

An antenna structure includes a first feeding source, a second feeding source, and a ring-shaped frame. The ring-shaped frame defines a first radiating portion and a second radiating portion. A current signal flows from the first feeding source to the first radiating portion, the first radiating portion activates a first resonance mode and a second resonance mode simultaneously to generate radiation signals in a first frequency band and a second frequency band. A current signal flows from the second feeding source to the second radiating portion, the second radiating portion activates a third resonance mode and a fourth resonance mode simultaneously to generate radiation signals in a third frequency band and a fourth frequency band. A wireless communication device is also provided.

20 Claims, 14 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201810010809.0 filed on Jan. 5, 2018, the contents of which are incorporated by reference herein.

FIELD

The subject matter herein generally relates to antenna structures and wireless communication devices.

BACKGROUND

Antennas are important elements of wireless communication devices, such as mobile phones or personal digital assistants. To communicate in multi-band communication systems, a bandwidth of an antenna in the wireless communication device needs to be wide enough to cover frequency bands of multiple bands. In addition, the antenna of the wireless communication device is almost a monopole antenna or an inverted f-shaped antenna. The antenna needs to include one or more clearance areas to promote radiation performance and a metal chassis of the wireless communication device needs to include one or more plastic areas.

BRIEF DESCRIPTION OF THE DRAWINGS

Implementations of the present technology will now be described, by way of example only, with reference to the attached figures.

DETAILED DESCRIPTION

Figure 1:
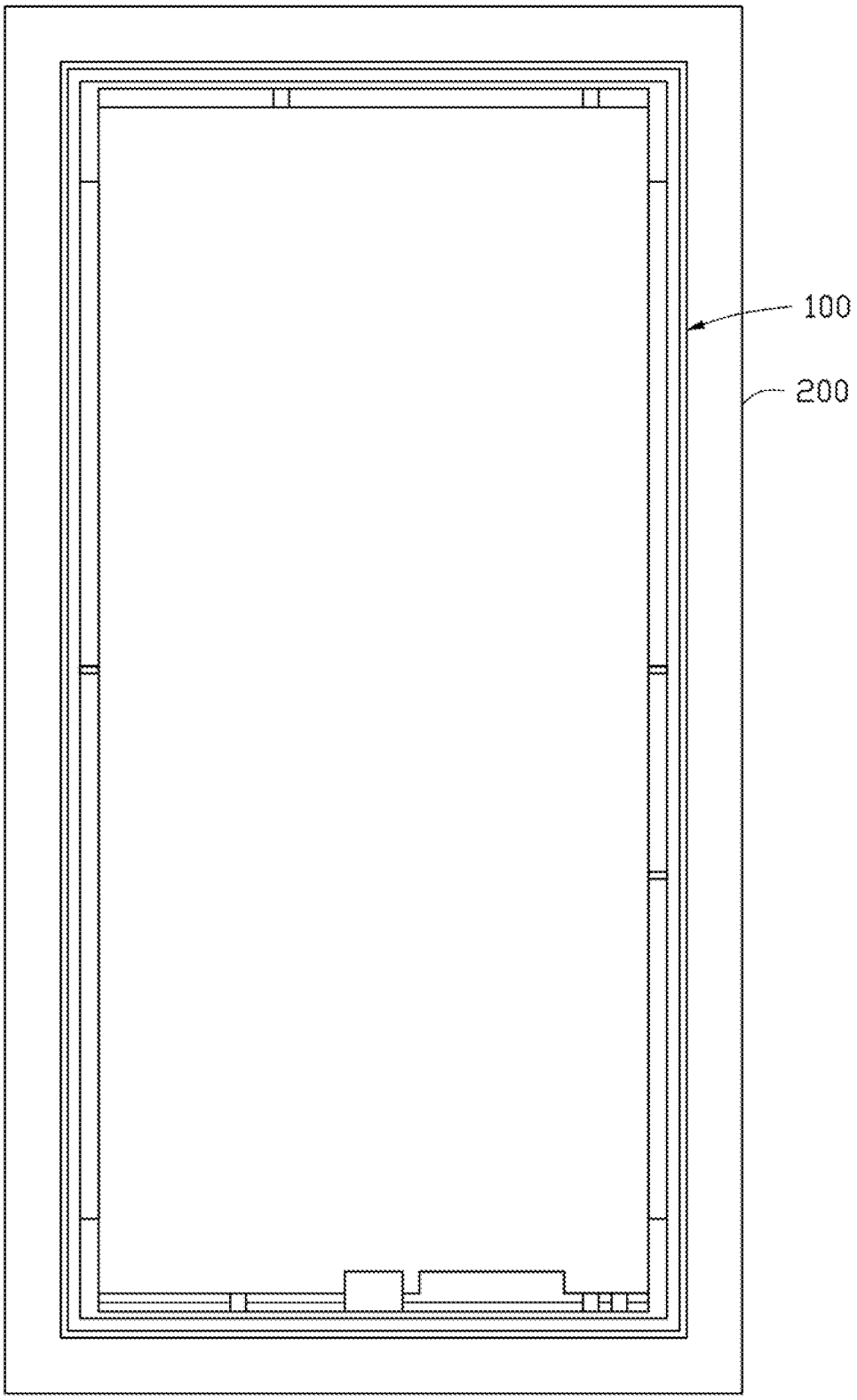
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. It should be noted that references to "an" or "one" embodiment in this disclosure are not necessarily to the same embodiment, and such references mean "at least one".

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200. The wireless communication device 200 comprises an antenna structure 100, and the antenna structure 100 is configured to transmit and receive wireless signals. The wireless communication device 200 can be a mobile phone, a personal digital assistant, or a MP3 player, for example.

Figure 2:
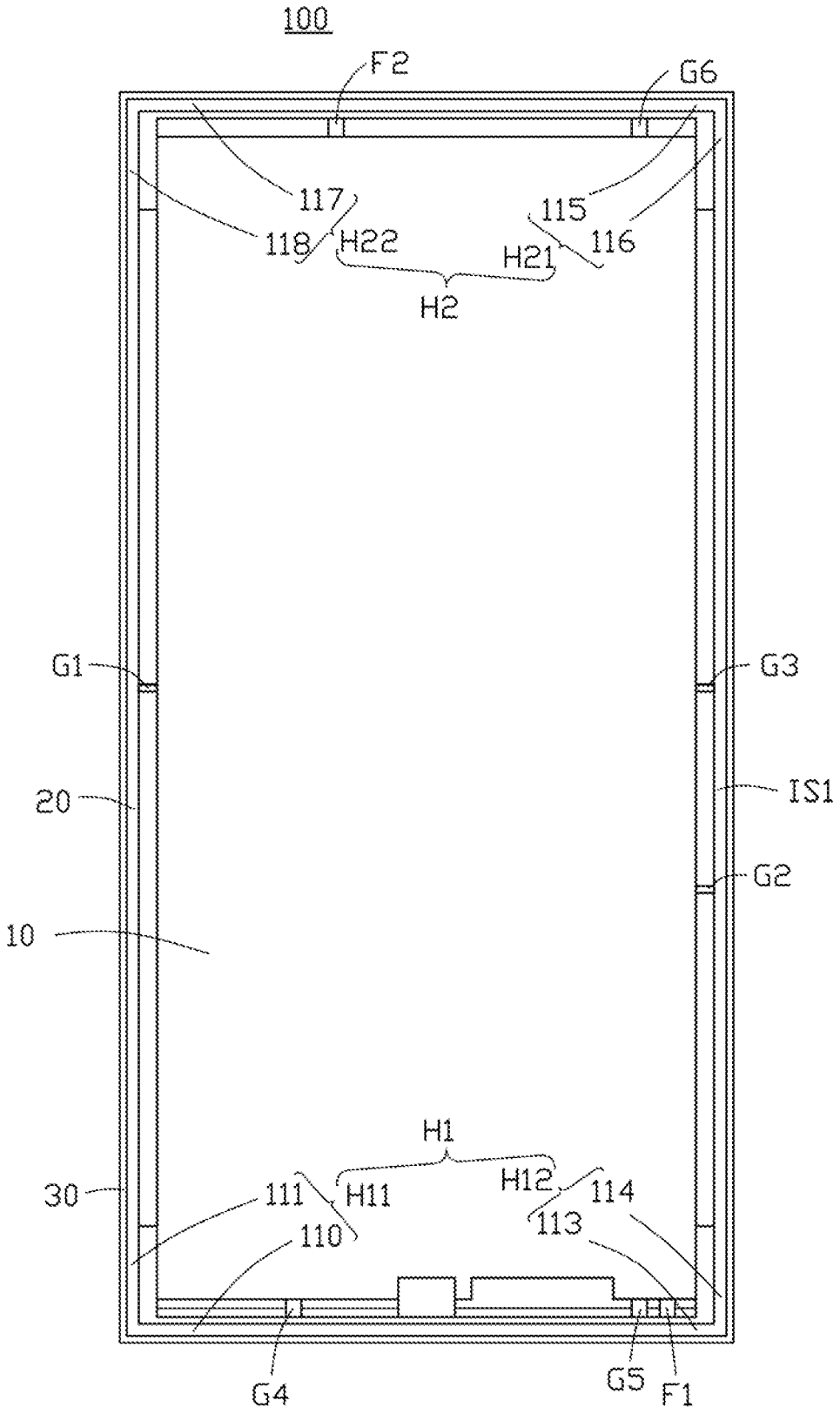
FIG. 2 is an isometric view of an embodiment of the antenna structure.
Figure 3:
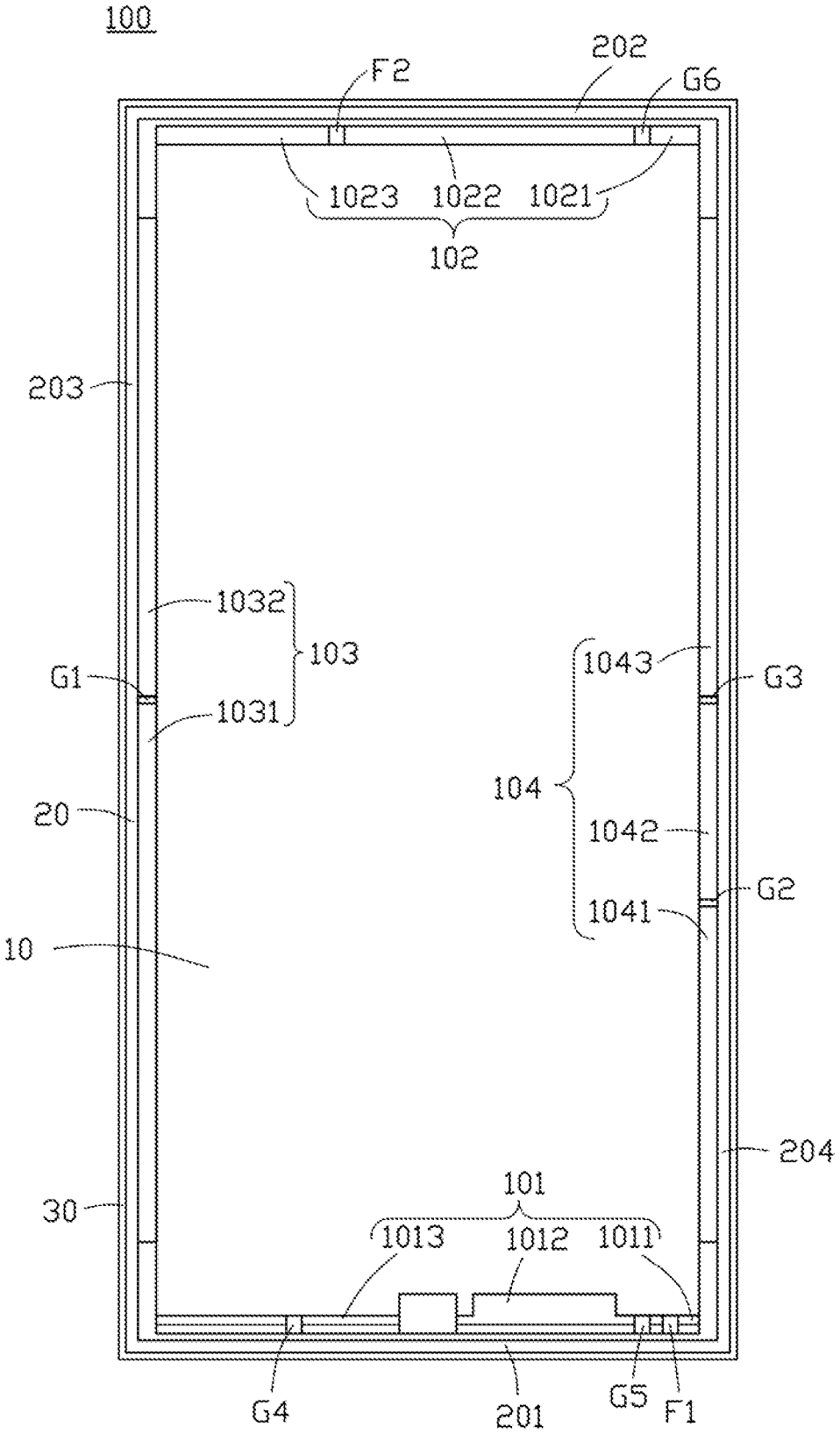
FIG. 3 is similar to FIG. 2, but shown from another angle.
Figure 4:
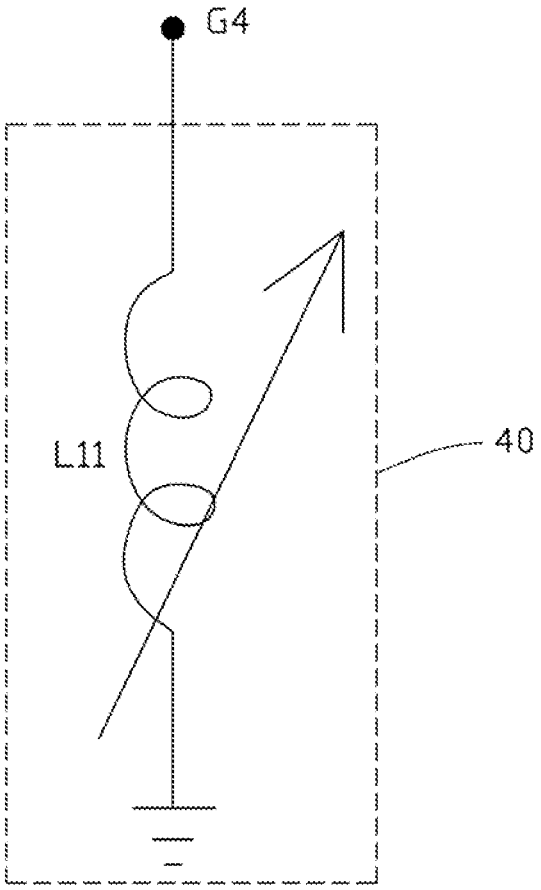
FIG. 4 is a circuit diagram of an embodiment of a first switch circuit.

Referring to FIG. 2 and FIG. 3, the antenna structure 100 comprises a ground plane 10, a ring-shaped frame 20, a first feeding source F1, and a second feeding source F2. The ring-shaped frame 20 defines a first radiating portion H1 and a second radiating portion H2.

In one embodiment, the ring-shaped frame 20 can be a continuous ring-shaped metal frame that has no gap or breakpoint. The ground plane 10 can be a ground area of a baseboard 30. The ring-shaped frame 20 can be positioned on the baseboard 30. For example, the ring-shaped frame 20 is positioned on an edge area of the baseboard 30. A size and a shape of the baseboard 30 is substantially equal to a size and a shape of the ring-shaped frame 20.

The first feeding source F1 is coupled to the first radiating portion H1. When a current signal flows from the first feeding source F1 to the first radiating portion H1, the first radiating portion H1 can activate a first resonance mode and a second resonance mode simultaneously to generate radiation signals in a first frequency band and a second frequency band. The second feeding source F2 is coupled to the second radiating portion H2. When a current signal flows from the second feeding source F2 to the second radiating portion H2, the second radiating portion H2 can activate a third resonance mode and a fourth resonance mode simultaneously to generate radiation signals in a third frequency band and a fourth frequency band.

In one embodiment, frequencies of the second frequency band are higher than frequencies of the first frequency band, and frequencies of the fourth frequency band are higher than frequencies of the third frequency band.

In one embodiment, the antenna structure 100 further comprises a first ground portion G1, a second ground portion G2, and a third ground portion G3. The first ground portion G1, the second ground portion G2, and the third ground portion G3 are respectively coupled between the ring-shaped frame 20 and the ground plane 10. The ring-shaped frame 20 is divided into the first radiating portion H1, the second radiating portion H2, and an isolation portion IS1 through the first ground portion G1, the second ground portion G2, and the third ground portion G3. The first radiating portion H1, the first feeding source F1, the first ground portion G1, and the second ground portion G2 can form a first antenna. The second radiating portion H2, the second feeding source F2, the first ground portion G1, and the third ground portion G3 can form a second antenna. The isolation portion IS1 is located between the first radiating portion H1 and the second radiating portion H2.

In one embodiment, the first antenna can be a main antenna and the second antenna can be a diversity antenna. The isolation portion IS1 is a portion of the ring-shaped frame 20 from the second ground portion G2 to the third ground portion G3. The isolation portion IS1 is configured to increase isolation between the first antenna and the second antenna.

In one embodiment, the ground plane 10 can be substantially rectangle shape. The ring-shaped frame 20 can be rectangle ring shape. The ring-shaped frame 20 comprises a first side edge 201, a second side edge 202, a third side edge 203, and a fourth side edge 204.

The first feeding source F1 is coupled to the first side edge 201, and a node between the first feeding source F1 and the first side edge 201 is located nearby the fourth side edge 204. The second feeding source F2 is coupled to the second side edge 202, and a node between the second feeding source F2 and the second side edge 202 is located nearby the third side edge 203. The first ground portion G1 is coupled to the third side edge 203, and a node between the first ground portion G1 and the third side edge 203 is located nearby a midpoint of the third side edge 203. The second ground portion G2 is coupled to the fourth side edge 204, and a node between the second ground portion G2 and the fourth side edge 204 is located nearby the first side edge 201. The third ground portion G3 is coupled to the fourth side edge 204, and a node between the third ground portion G3 and the fourth side edge 204 is located nearby the second side edge 203.

A first clearance area 101, a second clearance area 102, a third clearance area 103, and a fourth clearance area 104 are respectively located at four edge areas of the ground plane 10. The first clearance area 101 and the second clearance area 102 are located respectively at the lower edge area and the upper edge area of the ground plane 10. The first clearance area 101 is positioned nearby the first side edge 201 and the second clearance area 102 is positioned nearby the second side edge 202. The third clearance area 103 and the fourth clearance area 104 are located respectively at the left edge area and the right edge area of the ground plane 10. The third clearance area 103 is positioned nearby the third side edge 203 and the fourth clearance area 104 is positioned nearby the fourth side edge 204.

In one embodiment, the ground plane 10 can be located on insides of the first clearance area 101, the second clearance area 102, the third clearance area 103, and the fourth clearance area 104. The ring-shaped frame 20 can be located on outsides of the first clearance area 101, the second clearance area 102, the third clearance area 103, and the fourth clearance area 104.

In one embodiment, the clearance areas 101-104 are metal-free areas. For example, the clearance areas 101-104 are areas of a printed circuit board (PCB) that are cleared the copper foil from the PCB.

In one embodiment, the clearance areas 101-104 are not connected with each other. Insulation materials are positioned between adjacent clearance areas 101-104. The insulation materials can be plastics, rubbers, or adhesives.

In one embodiment, the first clearance area 101 is positioned nearby the first radiating portion H1. The first clearance area 101 comprises a first sub clearance area 1011, a second sub clearance area 1012, and a third sub clearance area 1013. The first sub clearance area 1011, the second sub clearance area 1012, and the third sub clearance area 1013 are substantially rectangle shape. The second sub clearance area 1012 is located between the first sub clearance area 1011 and the third sub clearance area 1013. A width of the first sub clearance area 1011 and a width of the third sub clearance area 1013 are both less than a width of the second sub clearance area 1012.

The second clearance area 102 is positioned nearby the second radiating portion H2. The second clearance area 102 comprises a fourth sub clearance area 1021, a fifth sub clearance area 1022, and a sixth sub clearance area 1023. The fourth sub clearance area 1021, the fifth sub clearance area 1022, and the sixth sub clearance area 1023 are substantially rectangle shape. The fifth sub clearance area 1022 is located between the fourth sub clearance area 1021 and the sixth sub clearance area 1023.

The third clearance area 103 comprises a seventh sub clearance area 1031 and an eighth sub clearance area 1032. The seventh sub clearance area 1031 and the eighth sub clearance area 1032 are substantially rectangle shape. The seventh sub clearance area 1031 is positioned nearby the first radiating portion H1 and the eighth sub clearance area 1032 is positioned nearby the second radiating portion H2. The fourth clearance area 104 comprises a ninth sub clearance area 1041, a tenth sub clearance area 1042, and an eleventh sub clearance area 1043. The ninth sub clearance area 1041, the tenth sub clearance area 1042, and the eleventh sub clearance area 1043 are substantially rectangle shape. The ninth sub clearance area 1041 is positioned nearby the first radiating portion H1, the tenth sub clearance area 1042 is positioned nearby the isolation portion IS1, and the eleventh sub clearance area 1043 is positioned nearby the second radiating portion H2.

In one embodiment, when a width of each of the clearance areas 101-104 is adjusted, a frequency band of the first radiating portion H1 and a frequency band of the second radiating portion H2 can also be adjusted.

A portion of the first radiating portion H1 from the first feeding source F1 to the first ground portion G1 forms a first branch H11, and a portion of the first radiating portion H1 from the first feeding source F1 to the second ground portion G2 forms a second branch H12. The first branch H11 is configured to activate the first resonance mode and the second branch H12 is configured to activate the second resonance mode. A portion of the second radiating portion H2 from the second feeding source F2 to the third ground portion G3 forms a third branch H21, and a portion of the second radiating portion H2 from the second feeding source F2 to the first ground portion G1 forms a fourth branch H22. The third branch H21 is configured to activate the third resonance mode and the fourth branch H22 is configured to activate the fourth resonance mode.

In one embodiment, the first feeding source F1, the first branch H11, and the first ground portion G1 form a first inverted F-shaped antenna to activate the first resonance mode to generate radiation signals in the first frequency band. The first feeding source F1, the second branch H12, and the second ground portion G2 form a second inverted F-shaped antenna to activate the second resonance mode to generate radiation signals in the second frequency band.

In one embodiment, the first resonance mode can be a medium and low frequency mode of the long term evolution advanced (LTE-A). The second resonance mode can be a high frequency mode of the LTE-A.

In one embodiment, frequencies of the second frequency band are higher than frequencies of the first frequency band. The first frequency band is 703-2170 MHz and the second frequency band is 2300-2690 MHz, for example.

The second feeding source F2, the third branch H21, and the third ground portion G3 form a third inverted F-shaped antenna to activate the third resonance mode to generate radiation signals in the third frequency band. The second feeding source F2, the fourth branch H22, and the first ground portion G1 form a fourth inverted F-shaped antenna to activate the fourth resonance mode to generate radiation signals in the fourth frequency band.

In one embodiment, the third resonance mode can be the medium and low frequency mode of the LTE-A. The fourth resonance mode can be the high frequency mode of the LTE-A.

In one embodiment, frequencies of the fourth frequency band are higher than frequencies of the third frequency band. The third frequency band is 703-2170 MHz and the fourth frequency band is 2300-2690 MHz, for example.

In one embodiment, the diversity antenna can work at a frequency band of global position system (GPS) band. The diversity antenna can be configured to receive GPS signals. The antenna structure 100 can add a duplexer or a signal extractor to extract the GPS signals from wireless signals received by the diversity antenna.

In one embodiment, the first branch H11 comprises a first sub radiating portion 110 and a second sub radiating portion 111. The first sub radiating portion 110 and the second sub radiating portion 111 are substantially rectangle shape. A first terminal of the first sub radiating portion 110 is vertically coupled to a first terminal of the second sub radiating portion 111, the first feeding source F1 is coupled to a second terminal of the first sub radiating portion 110, and the first ground portion G1 is coupled to a second terminal of the second sub radiating portion 111. The second branch H12 comprises a third sub radiating portion 113 and a fourth sub radiating portion 114. The third sub radiating portion 113 and the fourth sub radiating portion 114 are substantially rectangle shape. A first terminal of the third sub radiating portion 113 is vertically coupled to a first terminal of the fourth sub radiating portion 114, the first feeding source F1 is coupled to a second terminal of the third sub radiating portion 113, and the second ground portion G2 is coupled to a second terminal of the fourth sub radiating portion 114.

In one embodiment, the third branch H21 comprises a fifth sub radiating portion 115 and a sixth sub radiating portion 116. The fifth sub radiating portion 115 and the sixth sub radiating portion 116 are substantially rectangle shape. A first terminal of the fifth sub radiating portion 115 is vertically coupled to a first terminal of the sixth sub radiating portion 116, the second feeding source F2 is coupled to a second terminal of the fifth sub radiating portion 115, and the third ground portion G3 is coupled to a second terminal of the sixth sub radiating portion 116. The fourth branch H22 comprises a seventh sub radiating portion 117 and an eighth sub radiating portion 118. The seventh sub radiating portion 117 and the eighth sub radiating portion 118 are substantially rectangle shape. A first terminal of the seventh sub radiating portion 117 is vertically coupled to a first terminal of the eighth sub radiating portion 118, the second feeding source F2 is coupled to a second terminal of the seventh sub radiating portion 117, and the first ground portion G1 is coupled to a second terminal of the eighth sub radiating portion 118.

In one embodiment, the antenna structure 100 further comprises a fourth ground portion G4, a fifth ground portion G5, and a sixth ground portion G6. A first terminal of the fourth ground portion G4 is coupled to the first sub radiating portion 110, and a second terminal of the fourth ground portion G4 is coupled to the ground plane 10 (grounded). A node between the fourth ground portion G4 and the first sub radiating portion 110 is positioned nearby the second sub radiating portion 111. A first terminal of the fifth ground portion G5 is coupled to the third sub radiating portion 113, and a second terminal of the fifth ground portion G5 is coupled to the ground plane 10. A first terminal of the sixth ground portion G6 is coupled to the fifth sub radiating portion 115, and a second terminal of the sixth ground portion G6 is coupled to the ground plane 10. A node between the sixth ground portion G6 and the fifth sub radiating portion 115 is positioned nearby the sixth sub radiating portion 116.

Referring to FIG. 4 to FIG. 10, the antenna structure 100 further comprises a first switch circuit 40 to make the first radiating portion H1 having a preferred low frequency band. The first switch circuit 40 comprises a first adjustable inductor L11. A first terminal of the first adjustable inductor L11 is coupled to the first sub radiating portion 110 through the fourth ground portion G4, and a second terminal of the first adjustable inductor L11 is coupled to the ground plane 10 (grounded). When an inductance of the first adjustable inductor L11 is adjusted, the first frequency band of the first radiating portion H1 is adjusted.

In one embodiment, when the inductance of the first adjustable inductor L11 is adjusted, a low frequency band of the first radiating portion H1 is adjusted.

In one embodiment, the first switch circuit 40 comprises a switch unit 401 and a plurality of switch elements 402. The switch unit 401 is coupled to the first sub radiating portion 110 through the fourth ground portion G4. Each of the switch elements 402 can be inductors, capacitors, or a combination of the inductors and the capacitors. A first terminal of each of the switch elements 402 is coupled to the switch unit 401, and a second terminal of each of the switch elements 402 is coupled to the ground plane 10. The switch unit 401 can switch the first sub radiating portion 110 to connect to different switch elements 402.

In one embodiment, different switch elements 402 comprise different impedances. When different switch elements 402 are switched to connect the first sub radiating portion 110, the low frequency band of the first radiating portion H1 can be adjusted. For example, a number of the switch elements 402 is five and each switch element 402 comprises an inductor. Inductances of the switch elements 402 are respectively 5 nH, 8 nH, 10 nH, 15 nH, and 20 nH.

In one embodiment, the antenna structure 100 further comprises a resonance circuit 50 to make the first radiating portion H1 having a preferred medium frequency band. The resonance circuit 50 comprises a first inductor L1 and a first capacitor C1. A first terminal of the first capacitor C1 is coupled to the fifth ground portion G5, a second terminal of the first capacitor C1 is coupled to a first terminal of the first inductor L1, and a second terminal of the first inductor L1 is coupled to the ground plane 10. The first radiating portion H1 can work at a medium frequency band of 1710-2170 MHz through the first inductor L1 and the first capacitor C1. An inductance of the first inductor L1 is 2.2 nH and a capacitance of the first capacitor C1 is 0.5 pF, for example.

In one embodiment, the antenna structure 100 further comprises a first matching circuit 60. A current signal outputted by the first feeding source F1 can be transmitted to the first radiating portion H1 through the first matching circuit 60. The first matching circuit 60 comprises a second capacitor C2 and a second inductor L2. A first terminal of the second capacitor C2 is coupled to the first feeding source F1, a second terminal of the second capacitor C2 is coupled to the first radiating portion H1. A first terminal of the second inductor L2 is coupled to second terminal of the second capacitor C2, and a second terminal of the second inductor L2 is coupled to the ground plane 10. An inductance of the second inductor L2 is 9.1 nH and a capacitance of the second capacitor C2 is 2.7 pF, for example.

In one embodiment, the first ground portion G1 is further coupled to a first terminal of a third inductor L3, and a second terminal of the third inductor L3 is coupled to the ground plane 10. The third ground portion G3 is further coupled to a first terminal of a fourth inductor L4, and a second terminal of the fourth inductor L4 is coupled to the ground plane 10. An inductance of the third inductor L3 is 0.5 nH and an inductance of the fourth inductor L4 is 19.5 nH, for example.

In one embodiment, the antenna structure 100 further comprises a second switch circuit 70 to make the second radiating portion H2 having a preferred low frequency band. The second switch circuit 40 comprises a second adjustable inductor L22. A first terminal of the second adjustable inductor L22 is coupled to the fifth sub radiating portion 115 through the sixth ground portion G6, and a second terminal of the second adjustable inductor L22 is coupled to the ground plane 10. When an inductance of the second adjustable inductor L22 is adjusted, the third frequency band of the second radiating portion H2 is adjusted.

In one embodiment, when the inductance of the second adjustable inductor L22 is adjusted, a low frequency band of the second radiating portion H2 is adjusted.

The antenna structure 100 further comprises a second matching circuit 80. A current signal outputted by the second feeding source F2 can be transmitted to the second radiating portion H2 through the second matching circuit 80. The second matching circuit 80 comprises a third capacitor C3 and a third adjustable inductor L33. A first terminal of the third capacitor C3 is coupled to the second feeding source F2, a second terminal of the third capacitor C3 is coupled to the second radiating portion H2. A first terminal of the third adjustable inductor L33 is coupled to a node between the second feeding source F2 and the third capacitor C3, and a second terminal of the third adjustable inductor L33 is coupled to the ground plane 10. When the inductance of the third adjustable inductor L33 is adjusted, the low frequency band of the second radiating portion H2 can also be adjusted.

In one embodiment, when the inductance of the second adjustable inductor L22 and the inductance of the third adjustable inductor L33 are simultaneously adjusted, the low frequency band of the second radiating portion H2 can also be adjusted.

Figure 5:
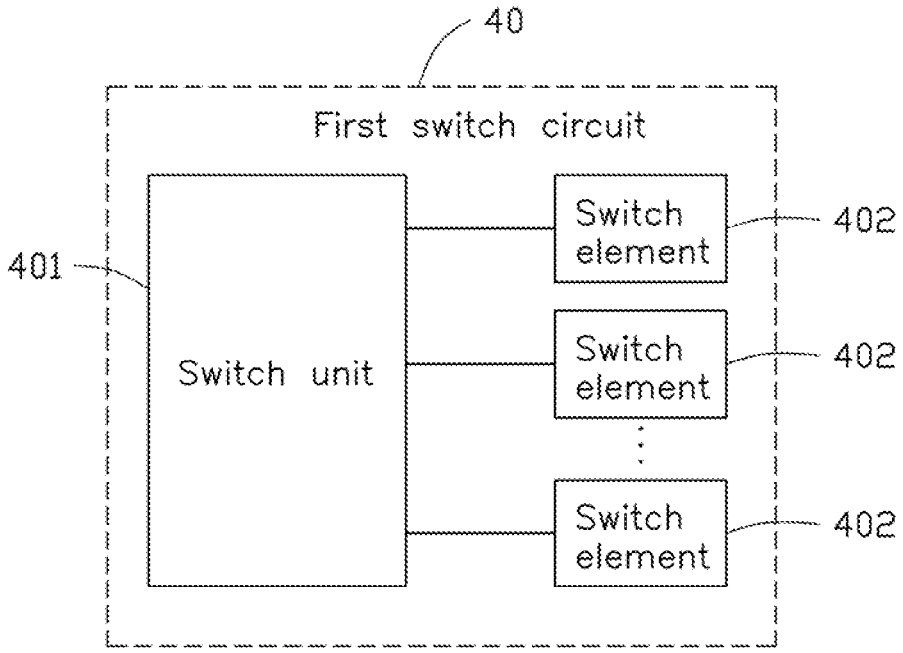
FIG. 5 is a block diagram of an embodiment of the first switch circuit.
Figure 6:
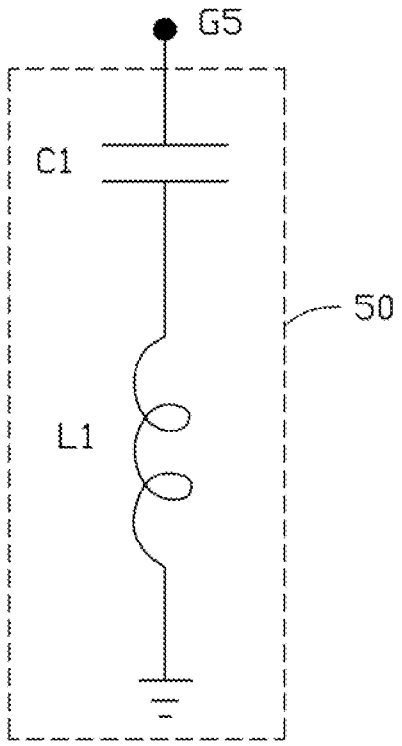
FIG. 6 is a circuit diagram of an embodiment of a resonance circuit.
Figure 7:
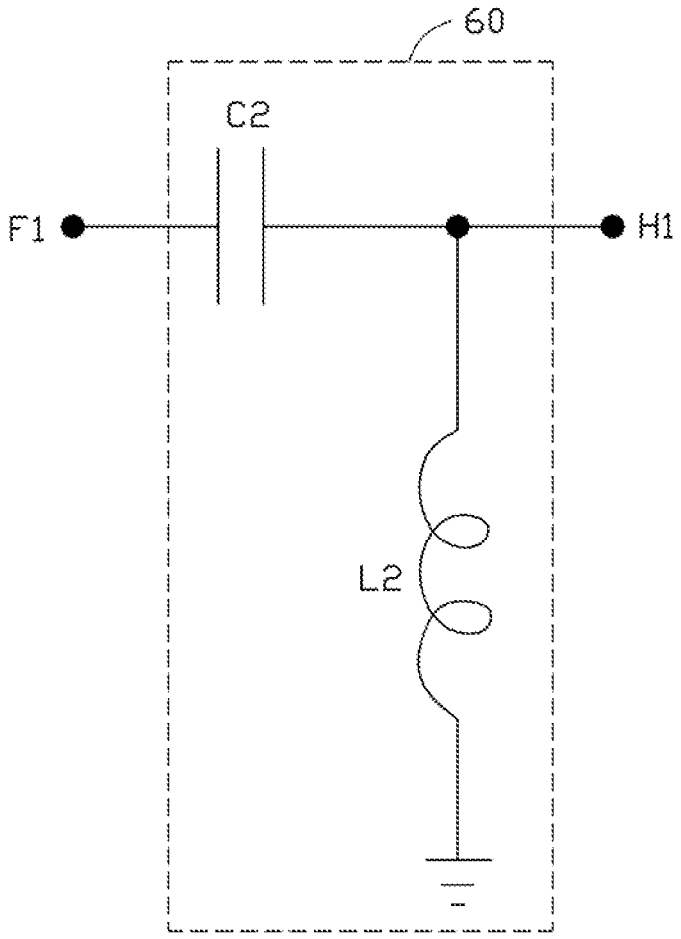
FIG. 7 is a circuit diagram of an embodiment of a first matching circuit.
Figure 8:
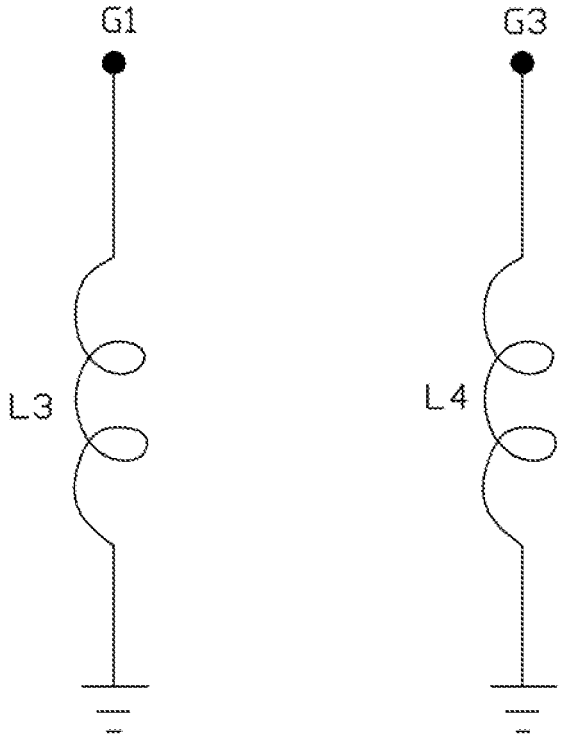
FIG. 8 is a circuit diagram of an embodiment of a first ground portion and a third ground portion grounded.
Figure 9:
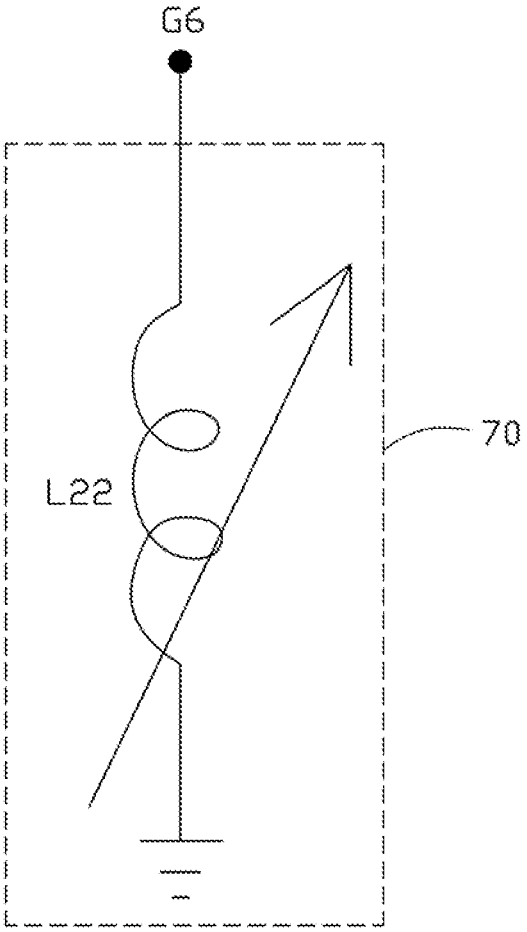
FIG. 9 is a circuit diagram of an embodiment of a second switch circuit.
Figure 10:
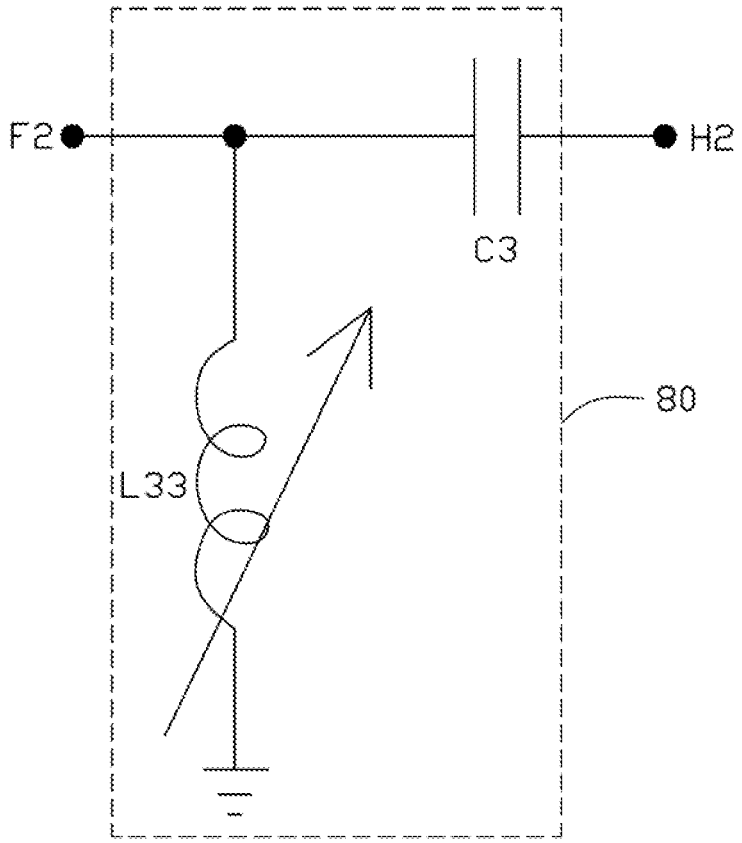
FIG. 10 is a circuit diagram of an embodiment of a second matching circuit.

In one embodiment, the second adjustable inductor L22 and the third adjustable inductor L33 can be replaced by the first switch circuit 40 of the FIG. 5.

Figure 11:
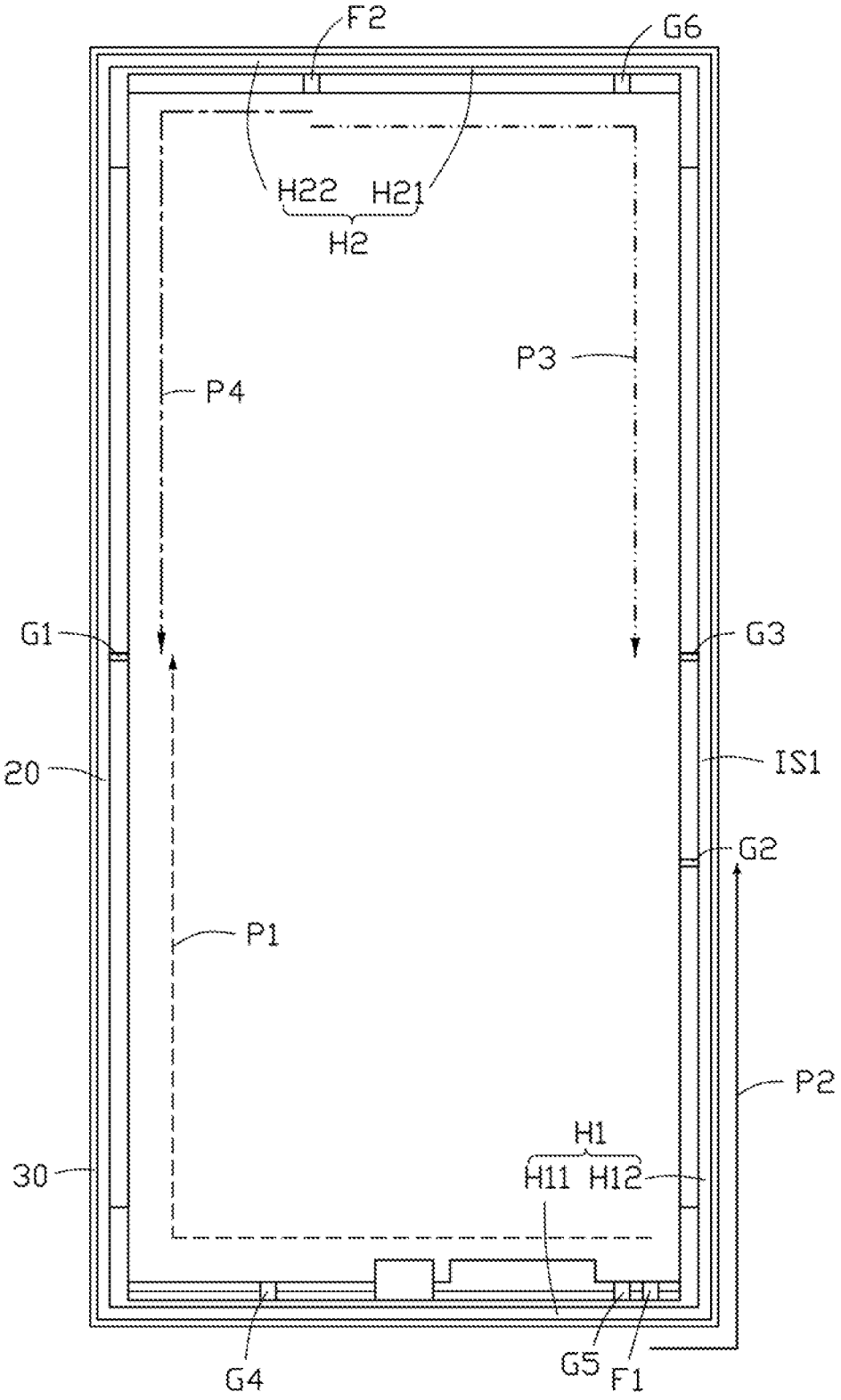
FIG. 11 is a current direction diagram of an embodiment of the antenna structure of FIG. 1.

Referring to FIG. 11, when a first current signal flows from the first feeding source F1 to the first radiating portion H1, a part of the first current signal flows to the first ground portion G1 through the first branch H11 to activate the first resonance mode to generate radiation signals in the first frequency band (first path P1). Another part of the first current signal flows to the second ground portion G2 through the second branch H12 to activate the second resonance mode to generate radiation signals in the second frequency band (second path P2).

When a second current signal flows from the second feeding source F2 to the second radiating portion H2, a part of the second current signal flows to the third ground portion G3 through the third branch H21 to activate the third resonance mode to generate radiation signals in the third frequency band (third path P3). Another part of the second current signal flows to the first ground portion G1 through the fourth branch H22 to activate the fourth resonance mode to generate radiation signals in the fourth frequency band (fourth path P4).

Figure 12:
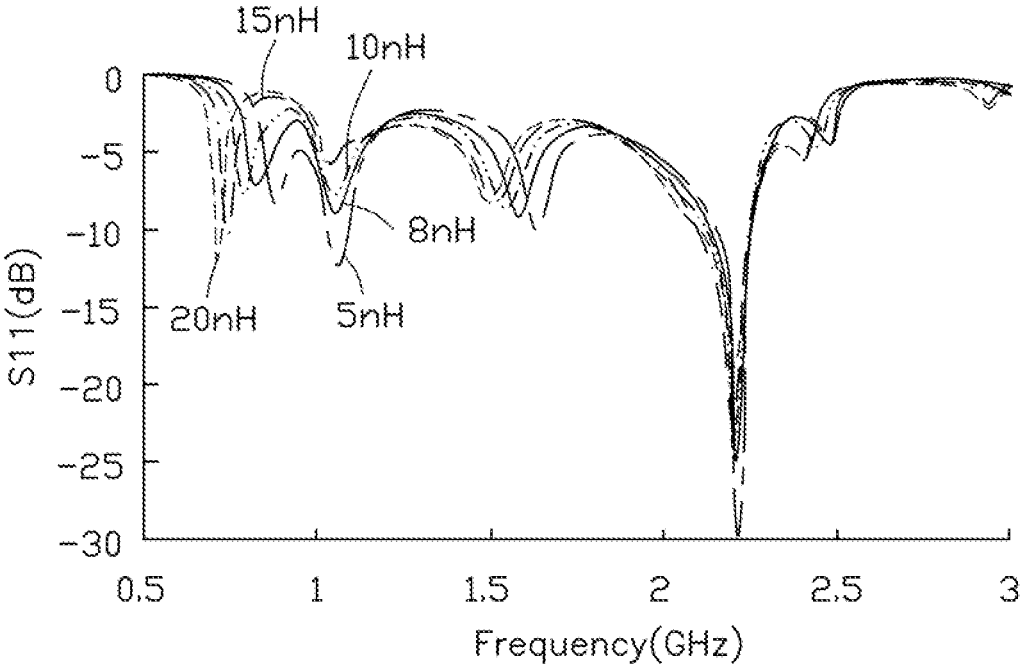
FIG. 12 is a scattering parameter graph of an embodiment of a main antenna working at medium and low frequency modes.

FIG. 12 illustrates an embodiment of a scattering parameter graph of the first antenna of the antenna structure 100 when the first antenna work at the medium and low frequency mode of the LTE-A. When the first switch circuit controls the switch unit 401 to switch different switch elements 402 (inductances of the switch elements 402 are respectively 5 nH, 8 nH, 10 nH, 15 nH, and 20 nH), the low frequency band of the first antenna can be adjusted.

Figure 13:
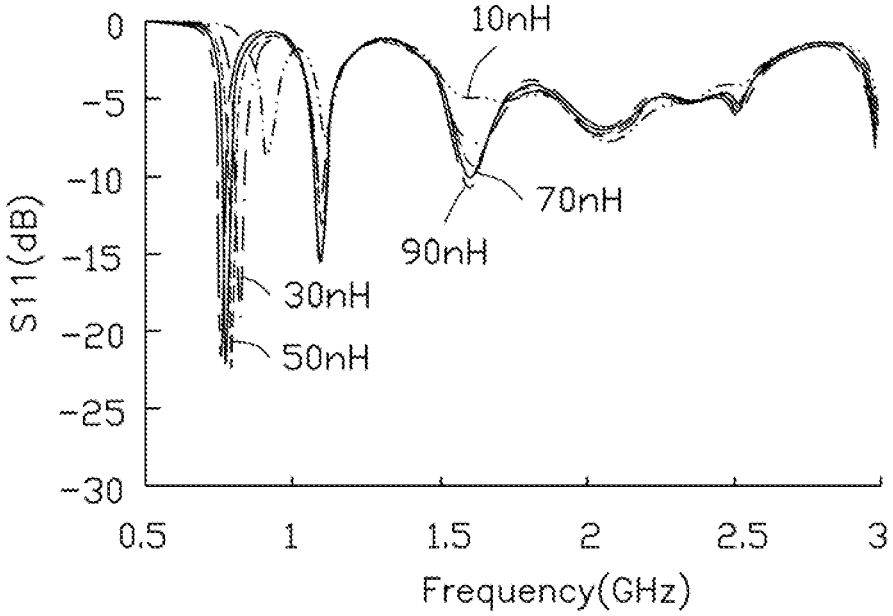
FIG. 13 is a scattering parameter graph of an embodiment of a diversity antenna working at medium and low frequency modes.

FIG. 13 illustrates an embodiment of a scattering parameter graph of the second antenna of the antenna structure 100 when the second antenna work at the medium and low frequency mode of the LTE-A. When the inductance of the second adjustable inductor L22 of the second switch circuit 70 is adjusted (inductances of the second adjustable inductor L22 are respectively 10 nH, 30 nH, 50 nH, 70 nH, and 90 nH), the low frequency band of the second antenna can be adjusted.

Figure 14:
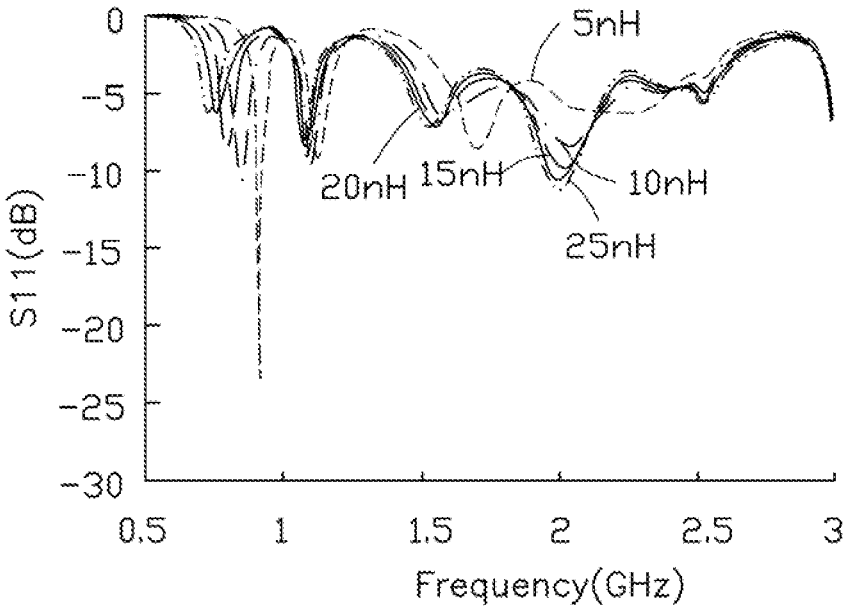
FIG. 14 is a scattering parameter graph of another embodiment of the diversity antenna working at the medium and low frequency modes.

FIG. 14 illustrates another embodiment of the scattering parameter graph of the second antenna of the antenna structure 100 when the second antenna work at the medium and low frequency mode of the LTE-A. When the inductance of the third adjustable inductor L33 of the second matching circuit 80 is adjusted (inductances of the third adjustable inductor L33 are respectively 5 nH, 10 nH, 15 nH, 20 nH, and 25 nH), the low frequency band of the second antenna can be adjusted.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims.

It will therefore be appreciated that the embodiments described above may be modified within the scope of the claims.

What is claimed is:

1. An antenna structure comprising:

a first feeding source;

a second feeding source;

a ring-shaped frame defining a first radiating portion and a second radiating portion;

a first ground portion;

a second ground portion; and a third ground portion;

wherein the first feeding source is coupled to the first radiating portion, when a current signal flows from the first feeding source to the first radiating portion, the first radiating portion activates a first resonance mode and a second resonance mode simultaneously to generate radiation signals in a first frequency band and a second frequency band; the second feeding source is coupled to the second radiating portion, when a current signal flows from the second feeding source to the second radiating portion, the second radiating portion activates a third resonance mode and a fourth resonance mode simultaneously to generate radiation signals in a third frequency band and a fourth frequency band;

frequencies of the second frequency band are higher than frequencies of the first frequency band, and frequencies of the fourth frequency band are higher than frequencies of the third frequency band; and wherein the first ground portion, the second ground portion, and the third ground portion are coupled between the ring-shaped frame and a ground plane; the ring-shaped frame is divided into the first radiating portion, the second radiating portion, and an isolation portion through the first ground portion, the second ground portion, and the third ground portion.

2. The antenna structure of claim 1, wherein the ring-shaped frame is a continuous ring-shaped metal frame that has no gap or breakpoint.

3. The antenna structure of claim 2, wherein the isolation portion is located between the first radiating portion and the second radiating portion.

4. The antenna structure of claim 3, wherein the ground plane is substantially rectangle shape; a first clearance area, a second clearance area, a third clearance area, and a fourth clearance area are located at edge areas of the ground plane; the first clearance area and the second clearance area are located respectively at an upper edge area and a lower edge area of the ground plane; and the third clearance area and the fourth clearance area are located respectively at a left edge area and a right edge area of the ground plane.

5. The antenna structure of claim 4, wherein the first clearance area is positioned nearby the first radiating portion, the second clearance area is positioned nearby the second radiating portion; the third clearance area comprises a first sub clearance area and a second sub clearance area, the first sub clearance area is positioned nearby the first radiating portion, and the second sub clearance area is positioned nearby the second radiating portion; the fourth clearance area comprises a third sub clearance area, a fourth sub clearance area, and a fifth sub clearance area, the third sub clearance area is positioned nearby the first radiating portion, the fourth sub clearance area is positioned nearby the isolation portion, and the fifth sub clearance area is positioned nearby the second radiating portion.

6. The antenna structure of claim 4, wherein the first clearance area comprises a sixth sub clearance area, a seventh sub clearance area, and an eighth sub clearance area, the seventh sub clearance area is located between the sixth sub clearance area and the eighth sub clearance area, a width of the sixth sub clearance area and a width of the eighth sub clearance area are both less than a width of the seventh sub clearance area; and the second clearance area comprises a ninth sub clearance area, a tenth sub clearance area, and an eleventh sub clearance area, and the tenth sub clearance area is located between the ninth sub clearance area and the eleventh sub clearance area.

7. The antenna structure of claim 3, wherein a portion of the first radiating portion from the first feeding source to the first ground portion forms a first branch, and a portion of the first radiating portion from the first feeding source to the second ground portion forms a second branch; the first branch is configured to activate the first resonance mode, and the second branch is configured to activate the second resonance mode; a portion of the second radiating portion from the second feeding source to the third ground portion forms a third branch, and a portion of the second radiating portion from the second feeding source to the first ground portion forms a fourth branch; the third branch is configured to activate the third resonance mode, and the fourth branch is configured to activate the fourth resonance mode.

8. The antenna structure of claim 7, further comprising a fourth ground portion, a fifth ground portion, and a sixth ground portion; wherein a first terminal of the fourth ground portion is coupled to the first branch, and a second terminal of the fourth ground portion is coupled to the ground plane; a first terminal of the fifth ground portion is coupled to the second branch, and a second terminal of the fifth ground portion is coupled to the ground plane; and a first terminal of the sixth ground portion is coupled to the third branch, and a second terminal of the sixth ground portion is coupled to the ground plane.

9. The antenna structure of claim 8, further comprising a first switch circuit and a resonance circuit; wherein the first switch circuit comprises a first adjustable inductor, a first terminal of the first adjustable inductor is coupled to the first branch through the fourth ground portion, and a second terminal of the first adjustable inductor is coupled to the ground plane; the first frequency band is adjusted in response to an inductance of the first adjustable inductor being adjusted; and the resonance circuit comprises a first inductor and a first capacitor, a first terminal of the first capacitor is coupled to the fifth ground portion, a second terminal of the first capacitor is coupled to a first terminal of the first inductor, and a second terminal of the first inductor is coupled to the ground plane.

10. The antenna structure of claim 8, further comprising a second switch circuit and a matching circuit; wherein the second switch circuit comprises a second adjustable inductor, a first terminal of the second adjustable inductor is coupled to the third branch through the sixth ground portion, and a second terminal of the second adjustable inductor is coupled to the ground plane; and the matching circuit comprises a third adjustable inductor and a third capacitor, a first terminal of the third capacitor is coupled to the second feeding source, and a second terminal of the third capacitor is coupled to the second radiating portion, a first terminal of the third adjustable inductor is coupled to a node between the third capacitor and the second feeding source, and a second terminal of the third adjustable inductor is coupled to the ground plane; and the third frequency band is adjusted in response to an inductance of the second adjustable inductor and/or an inductance of the third adjustable inductor being adjusted.

11. A wireless communication device comprising an antenna structure, wherein the antenna structure comprises:

a first feeding source;

a second feeding source;

a ring-shaped frame defining a first radiating portion and a second radiating portion;

a first ground portion;

a second ground portion; and a third ground portion;

wherein the first feeding source is coupled to the first radiating portion, when a current signal flows from the first feeding source to the first radiating portion, the first radiating portion activates a first resonance mode and a second resonance mode simultaneously to generate radiation signals in a first frequency band and a second frequency band; the second feeding source is coupled to the second radiating portion, when a current signal flows from the second feeding source to the second radiating portion, the second radiating portion activates a third resonance mode and a fourth resonance mode simultaneously to generate radiation signals in a third frequency band and a fourth frequency band;

frequencies of the second frequency band are higher than frequencies of the first frequency band, and frequencies of the fourth frequency band are higher than frequencies of the third frequency band; and wherein the first ground portion, the second ground portion, and the third ground portion are coupled between the ring-shaped frame and a ground plane; the ring-shaped frame is divided into the first radiating portion, the second radiating portion, and an isolation portion through the first ground portion, the second ground portion, and the third ground portion.

12. The wireless communication device of claim 11, wherein the ring-shaped frame is a continuous ring-shaped metal frame that has no gap or breakpoint.

13. The wireless communication device of claim 12, wherein the isolation portion is located between the first radiating portion and the second radiating portion.

14. The wireless communication device of claim 13, wherein the ground plane is substantially rectangle shape; a first clearance area, a second clearance area, a third clearance area, and a fourth clearance area are located at edge areas of the ground plane; the first clearance area and the second clearance area are located respectively at an upper edge area and a lower edge area of the ground plane; and the third clearance area and the fourth clearance area are located respectively at a left edge area and a right edge area of the ground plane.

15. The wireless communication device of claim 14, wherein the first clearance area is positioned nearby the first radiating portion, the second clearance area is positioned nearby the second radiating portion; the third clearance area comprises a first sub clearance area and a second sub clearance area, the first sub clearance area is positioned nearby the first radiating portion, and the second sub clearance area is positioned nearby the second radiating portion; the fourth clearance area comprises a third sub clearance area, a fourth sub clearance area, and a fifth sub clearance area, the third sub clearance area is positioned nearby the first radiating portion, the fourth sub clearance area is positioned nearby the isolation portion, and the fifth sub clearance area is positioned nearby the second radiating portion.

16. The wireless communication device of claim 14, wherein the first clearance area comprises a sixth sub clearance area, a seventh sub clearance area, and an eighth sub clearance area, the seventh sub clearance area is located between the sixth sub clearance area and the eighth sub clearance area, a width of the sixth sub clearance area and a width of the eighth sub clearance area are both less than a width of the seventh sub clearance area; and the second clearance area comprises a ninth sub clearance area, a tenth sub clearance area, and an eleventh sub clearance area, and the tenth sub clearance area is located between the ninth sub clearance area and the eleventh sub clearance area.

17. The wireless communication device of claim 13, wherein a portion of the first radiating portion from the first feeding source to the first ground portion forms a first branch, and a portion of the first radiating portion from the first feeding source to the second ground portion forms a second branch; the first branch is configured to activate the first resonance mode, and the second branch is configured to activate the second resonance mode; a portion of the second radiating portion from the second feeding source to the third ground portion forms a third branch, and a portion of the second radiating portion from the second feeding source to the first ground portion forms a fourth branch; the third branch is configured to activate the third resonance mode, and the fourth branch is configured to activate the fourth resonance mode.

18. The wireless communication device of claim 17, wherein the antenna structure further comprises a fourth ground portion, a fifth ground portion, and a sixth ground portion; a first terminal of the fourth ground portion is coupled to the first branch, and a second terminal of the fourth ground portion is coupled to the ground plane; a first terminal of the fifth ground portion is coupled to the second branch, and a second terminal of the fifth ground portion is coupled to the ground plane; and a first terminal of the sixth ground portion is coupled to the third branch, and a second terminal of the sixth ground portion is coupled to the ground plane.

19. The wireless communication device of claim 18, wherein the antenna structure further comprises a first switch circuit and a resonance circuit; the first switch circuit comprises a first adjustable inductor, a first terminal of the first adjustable inductor is coupled to the first branch through the fourth ground portion, and a second terminal of the first adjustable inductor is coupled to the ground plane; the first frequency band is adjusted in response to an inductance of the first adjustable inductor being adjusted; and the resonance circuit comprises a first inductor and a first capacitor, a first terminal of the first capacitor is coupled to the fifth ground portion, a second terminal of the first capacitor is coupled to a first terminal of the first inductor, and a second terminal of the first inductor is coupled to the ground plane.

20. The wireless communication device of claim 18, wherein the antenna structure further comprises a second switch circuit and a matching circuit; the second switch circuit comprises a second adjustable inductor, a first terminal of the second adjustable inductor is coupled to the third branch through the sixth ground portion, and a second terminal of the second adjustable inductor is coupled to the ground plane; and the matching circuit comprises a third adjustable inductor and a third capacitor, a first terminal of the third capacitor is coupled to the second feeding source, and a second terminal of the third capacitor is coupled to the second radiating portion, a first terminal of the third adjustable inductor is coupled to a node between the third capacitor and the second feeding source, and a second terminal of the third adjustable inductor is coupled to the ground plane; and the third frequency band is adjusted in response to an inductance of the second adjustable inductor and/or an inductance of the third adjustable inductor being adjusted.

* * * * *